US006602148B2

(12) United States Patent
Hsu

(10) Patent No.: US 6,602,148 B2
(45) Date of Patent: Aug. 5, 2003

(54) GOLF CLUB SHAFT

(76) Inventor: Patrick Hsu, No. 132, Chung Yi Street, Taichung City (TW)

( * ) Notice: Subject to any disclaimer, the term of this patent is extended or adjusted under 35 U.S.C. 154(b) by 0 days.

(21) Appl. No.: 09/809,304

(22) Filed: Mar. 16, 2001

(65) Prior Publication Data

US 2002/0132682 A1 Sep. 19, 2002

(51) Int. Cl.[7] ..... A63B 53/10
(52) U.S. Cl. ..... 473/319
(58) Field of Search ..... 473/316–323; 428/36.3, 36.9; 264/635; 156/187, 188

(56) References Cited

U.S. PATENT DOCUMENTS 5,234,217 A * 8/1993 Johnson
5,385,767 A * 1/1995 Noguchi
5,437,450 A * 8/1995 Akatsuka
5,665,441 A * 9/1997 Suzue
5,904,627 A * 5/1999 Miyaji
5,961,395 A * 10/1999 You
6,270,426 B1 * 8/2001 Matsumoto

* cited by examiner

*Primary Examiner*—Stephen Blau
(74) *Attorney, Agent, or Firm*—Browdy and Neimark, P.L.L.C.

(57) ABSTRACT

A golf club shaft comprises a first section and a second section, wherein the first section is made of a fiber tow of composite material and formed a tube by filament winding method. The second section is made of a fiber layer of composite material and formed a tube by sheet-rolling method. The first and the second segment overlapped and fixed together to form the golf club shaft. The first segment is design to provide the golf club shaft to have a homogenous mechanical property, and the second segment is designed to provide the golf club shaft to have a superior deflection capacity

10 Claims, 2 Drawing Sheets

GOLF CLUB SHAFT

FIELD OF THE INVENTION

The present invention relates generally to a golf club, and more particularly to a golf club shaft made of composite material.

BACKGROUND OF THE INVENTION

The conventional methods for making a composite material golf club shaft are "sheet-rolling method" and "filament winding method". The sheet-rolling method includes the steps of cutting a fiber sheet preimpregnated with resin in accordance with predetermined various angles of fiber orientation into a plurality of sheets of various shapes and sizes. Stacking the fiber sheets together to form a fiber layer, and rolled it around an iron core. The advantage of the sheet-rolling method is the manufacturer can control the orientations of the fiber to make the shaft having a superior deflection capacity. But the disadvantage is the two edges of the fiber layer overlapped to form a "spine" on the shaft. The "spine" has more rigidity than the other section of the shaft to cause the shaft having an unhomogeneous mechanical property.

The filament winding method is winding a fiber tow around a core. Because of the winding procedure is controlled by a computer, so the shaft had a homogeneous mechanical property. But when winding, the orientations of the fibers are between 30 degrees to 45 degrees. It cannot provide an essential deflection capacity along the axle direction of the shaft.

Both of the methods described above cannot provide a perfect golf club shaft as people wishes.

SUMMARY OF THE INVENTION

The primary objective of the invention is to provide a golf club shaft, which has the advantages of the two methods described above.

According to the objective of the invention, a golf club shaft having a first segment and a second segment. The first segment is made by filament winding method, and the second is made by sheet-rolling method. The first segment and the second segment overlapped and fixed together to form the golf club shaft.

DETAIL DESCRIPTION OF THE INVENTION

Figure 2:
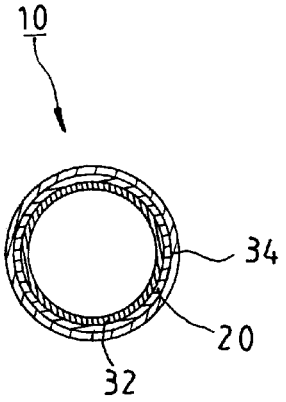
FIG. 2 shows the sectional view along line 2—2 in FIG. 1.
Figure 1:
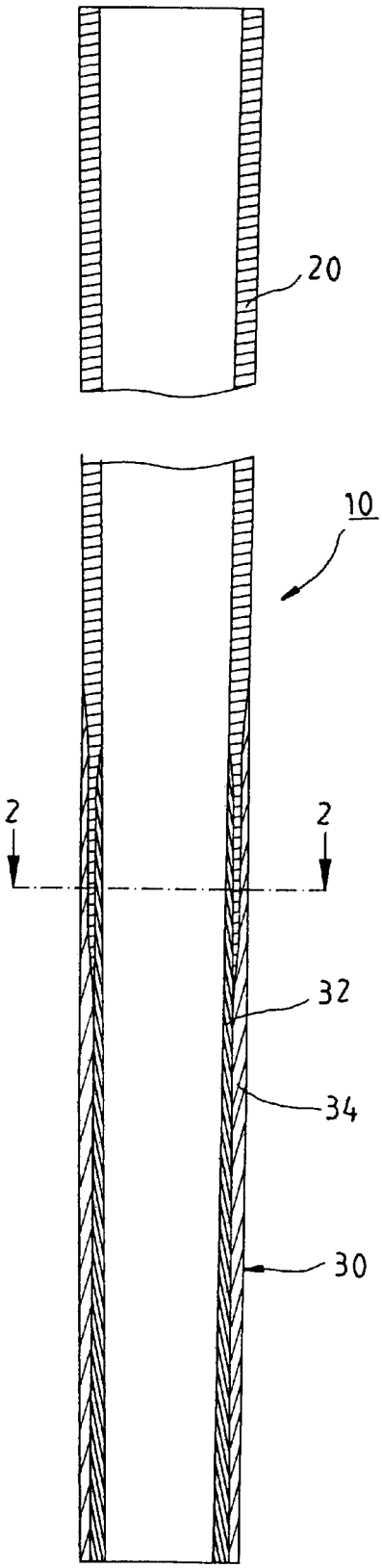
FIG. 1 shows the structure sketch of the first preferred embodiment.

Please refer to FIG. 1 and FIG. 2, the first preferred embodiment of the present invention provides a golf club shaft 10, which have a first segment 20 and a second segment 30. The first segment 20 shaped into a coned tube and located at the up section of the shaft 10 to have a grip (not shown) fixed on the butt end of thereof. The first segment 20 is made of carbon fiber (it also can be made of glass fiber, boron fiber or metal fiber) and is formed by the filament winding method as described above. The length of the first segment 20 is more than 6/7 of the length of the shaft 10. The second segment 30, made by sheet-rolling method, has a length more than 1/7 of the length of the shaft 10. The tip end of the first segment 20 overlapped the butt end of the second segment 30. In the first preferred embodiment, the second segment 30 had an inner layer 32 and an outer layer 34, wound around the outer side of the inner layer 32. At the overlapping section of the first segment 20 and the second segment 30, the inner layer 32 of the second segment 30 located at inner side of the shaft 10, the first segment 20 covered on the inner layer 32 of the second segment 30, and the outer layer 34 of the second segment 30 covered on the first segment 20.

To manufacture the shaft 10 of the first preferred embodiment of the present invention, first rolling a fiber layer preimpregnated with resin around the thinner side of a core (the sheet-rolling method) to form the tip section of the shaft 10. Second, winding a fiber tow preimpregnated with resin around the rest section of the core (the filament winding method) with the butt end covering on the tip end of the fiber layer. And then, baking it in an oven. After finish baking, the first segment 20 and the inner layer 32 of the second segment 30 are set. Next, rolling a fiber layer again around the core (the sheet-rolling method) at the outer side of the inner layer 32 of the second segment 30 and the butt end of the first segment 20. Sending it to bake again to form the outer layer 34 of the second segment 30. After the second time baking, the first segment 20, the inner layer 32 and the outer layer 34 of the second segment 30 are fixed together as a unit. Finally, removing the core, the golf club shaft 10 of the first preferred embodiment of the present invention is completed.

Usually the golf club shaft 10 provided a transparent layer (not shown) on the outer side thereof. The transparent layer could be made of a transparent glass fiber by the sheet-rolling method or could be coated with a transparent coating resine. But it is not the important specificity of the present invention.

The golf club shaft 10 also can be baked after the first segment 20, the inner layer 32 and the outer layer 34 of the second segment 30 had been set, or baked it at each time setting. It is a choice for manufacturer.

The first segment 20, made by the filament winding method and formed the major structure of the golf club shaft 10, is designed to provide a homogenous mechanical property of the golf club shaft 10. So, the golf club shaft 10 of the first preferred embodiment of the present invention has no "spine" as described above, and provide a better performance when swinging. The second segment 30, made by the sheet-rolling method, is designed to provide a superior deflection capacity by controlling the orientation of fiber of the second segment 30. Usually manufacturer can arrange the orientations of fibers on outer side of the second segment 30 along the axle direction of the shaft 10 to enhance the deflection capacity.

Figure 4:
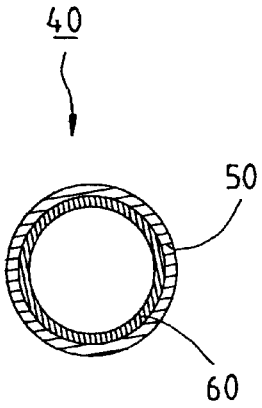
FIG. 4 shows the sectional view along line 4—4 in FIG. 1.
Figure 3:
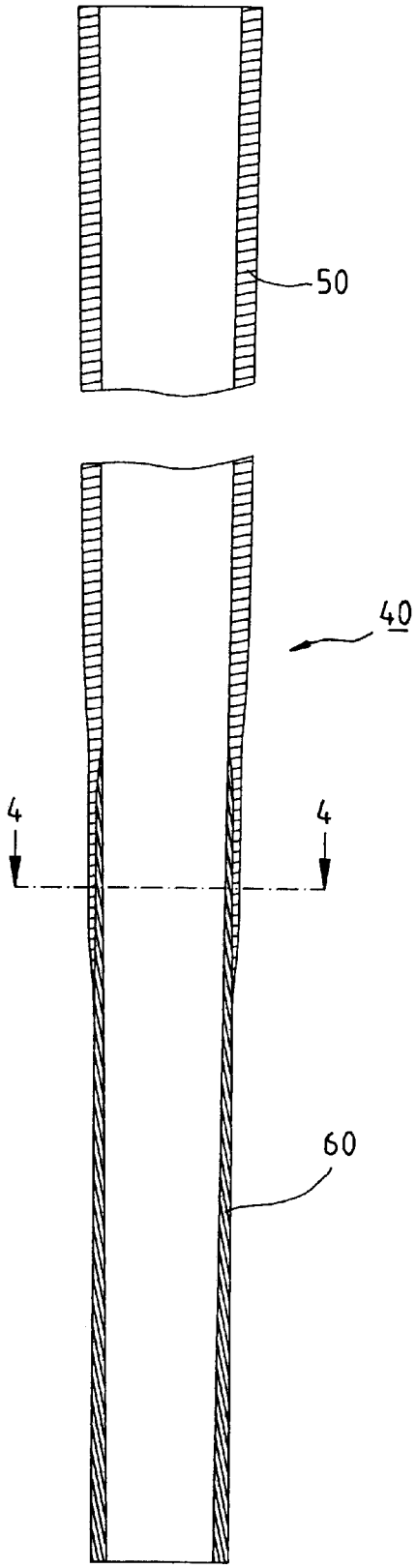
FIG. 3 shows the structure sketch of the second preferred embodiment.

FIG. 3 and FIG. 4 shows a golf club shaft 40 of the second preferred embodiment of the present invention. The golf club shaft 40 has a first segment 50 made by the filament winding method, and a second segment 60 made by the sheet-rolling method. Different from the first preferred embodiment, the second segment 60 has only one fiber layer, and its butt end is covered by the first segment 50. Of course, the shaft can be made of the second segment 60 covered on the first segment 50.

We have to mention here, the lengths of the first segment and the segment can change to provide a different level of the homogenous mechanical property and the deflection capacity of the golf club shift. The first segment, made by the filament winding method, can arrange at the tip section to connect to a golf club head, and the second segment, made by the sheet-rolling method, can arrange at the butt section to connect to a grip. Manufacture can choose to provide a golf club shaft with a designed property.

What is claimed is:

1. A golf club shaft comprising a first segment and a second segment;

said first segment being made by filament winding of a fiber tow of composite material forming a first tube;

said second segment being made by sheet rolling of a fiber layer of composite material forming a second tube;

an end of said first segment and an end of said second segment being overlapped and fixed together at a joint to form said golf club shaft;

wherein the end of said first segment and the end of said second segment each respectively have a length less than an entire length of the corresponding first segment or the corresponding second segment; and wherein said second segment has an inner layer and an outer layer, the outer layer being located on an outer side of said inner layer and fixed to said inner layer; said inner layer of said second segment covering said first segment; said outer layer of said second segment covering said first segment.

2. The golf club shaft as defined in claim 1, wherein the length of said first segment is larger than half of the length of said golf club shaft.

3. The golf club shaft as defined in claim 1, wherein said first segment covers an end of said second segment.

4. The golf club shaft as defined in claim 1, wherein said second segment covers an end of said first segment.

5. The golf club shaft as defined in claim 1, further comprising a transparent layer on the outer side of said golf club shaft.

6. A golf club shaft comprising a first segment and a second segment;

said first segment being made by filament winding of a fiber tow of composite material forming a first tube;

said second segment being made by sheet rolling of a fiber layer of composite material forming a second tube;

an end of said first segment and an end of said second segment being overlapped and fixed together to form said golf club shaft; and wherein said second segment has an inner layer and an outer layer, the outer layer being located on an outer side of said inner layer and fixed to said inner layer; said inner layer of said second segment covering said first segment; said outer layer of said second segment covering said first segment.

7. The golf club shaft as defined in claim 6, wherein the length of said first segment is larger than half of the length of said golf club shaft.

8. The golf club shaft as defined in claim 6, wherein said first segment covers an end of said second segment.

9. The golf club shaft as defined in claim 6, wherein said second segment covers an end of said first segment.

10. The golf club shaft as defined in claim 6, further comprising a transparent layer on the outer side of said golf club shaft.

* * * * *